US008430760B2

(12) United States Patent
Brassard

(10) Patent No.: US 8,430,760 B2
(45) Date of Patent: Apr. 30, 2013

(54) WATERSLIDE WITH ANGLED TRANSITION

(75) Inventor: Daniel Pierre Brassard, Vancouver (CA)

(73) Assignee: Whitewater West Industries Ltd. (CA)

( * ) Notice: Subject to any disclaimer, the term of this patent is extended or adjusted under 35 U.S.C. 154(b) by 423 days.

(21) Appl. No.: 12/504,102

(22) Filed: Jul. 16, 2009

(65) Prior Publication Data

US 2010/0016091 A1 Jan. 21, 2010

Related U.S. Application Data

(60) Provisional application No. 61/081,339, filed on Jul. 16, 2009.

(51) Int. Cl.
*A63G 21/18* (2006.01)

(52) U.S. Cl.
USPC ..... 472/117

(58) Field of Classification Search ..... 472/117
See application file for complete search history.

(56) References Cited

U.S. PATENT DOCUMENTS

| | | | | |
|---|---|---|---|---|
| 4,149,710 | A | 4/1979 | Rouchard | |
| 4,198,043 | A | 4/1980 | Timbes | |
| 4,836,521 | A * | 6/1989 | Barber | 472/13 |
| 5,137,497 | A | 8/1992 | Dubeta | |
| 6,450,891 | B1 | 9/2002 | Dubeta | |
| 6,729,963 | B2 | 5/2004 | Hlynka | |
| 6,743,107 | B2 | 6/2004 | Dubeta | |
| 6,857,964 | B2 | 2/2005 | Hunter | |
| 6,945,873 | B2 | 9/2005 | Hlynka | |
| 7,056,220 | B2 | 6/2006 | Hunter | |
| 2005/0282643 | A1 | 12/2005 | Hlynka | |
| 2006/0194638 | A1 * | 8/2006 | Hunter | 472/116 |

* cited by examiner

*Primary Examiner* — Michael Dennis
(74) *Attorney, Agent, or Firm* — Greenberg Traurig LLP

(57) ABSTRACT

The present disclosure provides a waterslide comprising an upstream flume segment having a first cross-section, the upstream flume segment defining a first slide path, and a downstream flume segment having a second cross-section different than the first cross-section, the downstream flume segment defining a second slide path. The waterslide further comprises an angled transition linking the upstream flume segment to the downstream flume segment, wherein the angled transition defines a discontinuity between the upstream and downstream flume segments, thereby defining an inflection between the first and second slide paths.

23 Claims, 8 Drawing Sheets

WATERSLIDE WITH ANGLED TRANSITION

CROSS-REFERENCE TO RELATED APPLICATION

This application claims the benefit of U.S. Provisional Patent Application No. 61/081,339, filed on Jul. 16, 2008, the disclosure of which is hereby expressly incorporated herein by reference.

BACKGROUND

Waterslides are popular ride attractions for water parks, theme parks, family entertainment centers and destination resorts. The popularity of waterslide rides has increased dramatically over the years, and park patrons continue to seek out more and more exciting and stimulating ride experiences. Thus, there is an ever present demand for different and more exciting waterslide designs that offer riders a unique ride experience and that give park owners the ability to draw larger crowds to their parks.

Waterslides generally include an inclined water conveying course having an entry at an upper end and an exit pool or other safe landing structure at a lower end with a flow of water between the entry and the exit. A waterslide user slides down the course under the influence of gravity, with or without a conveyance means such as a flexible plastic mat, tube or raft. The water provides cooling fun for the ride participants, and also acts as a lubricant so as to increase the speed of the rider down the flume. Generally, the slide course is arranged along a sinuous or serpentine path with a series of bends, twists and turns which enhance the amusement value of the waterslide.

Typically a waterslide is formed from a plurality of straight and curved ("macaroni-shaped") concave flume segments, connected together in an end to end relationship to define the inclined waterslide course. The flume segments can be closed tubes or open channels. The waterslide can comprise a mixture of different types of flume segments. For example, FIG. 1 of U.S. Patent Application Publication No. US2005/0282643 shows a waterslide comprising closed tube and open channel flume segments.

Often waterslide flume segments are fabricated from plastic or fiberglass resin composites and furnished with flanges via which they are bolted or otherwise fastened together. Most commonly the flume segments each consist of a constant cross-section and are either straight or swept along a straight or curved two- or three-dimensional space curve. In many cases the flume cross-section is circular. The linked cross-sections are typically congruent at their ends, thereby creating a composite path having, at all points, tangent vectors substantially normal to the cross-section of the flume or flume segments. Therefore it can be said that a typical waterslide flume consists of a generally constant cross-section swept across a continuous and smooth path.

It is not uncommon to connect flume segments having different cross-sections in a single waterslide. This is accomplished by use of a component known as a transition. A conventional transition is a generally straight segment of flume having at one end a cross-section identical to that of a first flume segment, and at the other end a cross-section identical to that of a second flume segment, with the first and second flume segments having a substantially constant cross-section along their length. The transition may be used to couple first and second straight flume segments or first and second curved flume segments, or a straight segment to a curved segment.

FIGS. 1 and 2 depict portions of prior art waterslides incorporating known transitions between flume segments having different cross-sections. For instance, FIG. 1 depicts a portion of a waterslide 100 having a transition 130 that connects a first upstream curved flume segment 110 having a first cross-sectional size and shape to a second downstream curved flume segment 120 having a larger and different cross-sectional size and shape. The transition 130 is a straight flume segment piece with a cross-section that changes along its length. Each cross-section of transition 130 is generally disposed perpendicular to a path which joins, in a continuous and smooth fashion, the slide path of first flume segment 110 and second flume segment 120. In this manner, the transition 130 provides a continuous, smooth composite slide path between the curved flume segments 110 and 120. Thus, cross-sections taken of the transition 130 (perpendicular to the slide path) between end flanges 140 and 150 (which are typically used to attach the transition 130 to the first and second flume segments 110 and 120, respectively) comprise generally smoothly modifying blends of the cross-sections of first flume segment 110 and second flume segment 120, thereby providing a safe and smooth ride path for the rider.

FIG. 2 depicts a plan view of a portion of a waterslide 200 with a transition 230 linking first and second straight flume segments 210 and 220, wherein the first, upstream flume segment 210 has a narrower cross-section than the second, downstream flume segment 220. The transition 230 is similar to the transition 130 used to link the curved flume segments in FIG. 1 in that the transition 230 is a straight flume segment with a cross-section that changes gradually along its length. Each cross-section of transition 230 is generally disposed perpendicular to the approximate linear ride path and direction of movement of the rider (shown as arrow 260) defined by the straight flume segments 210 and 220. As such, the transition 230 provides a continuous, smooth composite slide path between the straight flume segments. As shown in FIG. 2, the transition 230 may be generally curved as it extends outwardly from the first flume segments 210 to the second flume segment 220, or it may instead define a substantially straight outwardly-extending section that extends from the narrower flume segments 210 to the wider flume segment 220. In commonly used transitions, a curve joining the outward normals of the end faces of a transition is generally straight when viewed in plan.

Waterslides are distinct from many other amusement rides in that the actual path of a rider contains additional degrees of freedom beyond strict adherence to a path largely parallel to the slide path of the flumes in the waterslide. The rider (optionally on a raft or other conveyance device) can slide from side-to-side within the flume, while having an average direction of travel in the direction of the slide path. In most designs this side-to-side motion is inevitable due to the shape of the flume and the plan view of the slide path. In order for a rider to follow the slide path precisely, the flume underneath the path of the rider would need to tilt such that the normal acceleration due to a curved path of a rider moving at any velocity is counteracted entirely by the angle of the supporting surface with respect to the direction of gravity. As the flume does not rotate, the rider must translate across-the cross-section until the previously mentioned force balance is achieved. Certain waterslide rides rely entirely on the excitement of climbing a flume wall and then sliding downwards and then in some cases up another flume wall and so on in this side-to-side manner.

It is common in waterslides to use side-to-side oscillation and the attendant rise up the wall of the flume to create a safe yet more exciting ride experience. Oscillation is typically created by turns in the slide path of a waterslide. This generally requires long stretches and large radius turns in the slide path, using a large surface area of slide surface. Conventionally, wider flumes are used to permit larger side-to-side motion with higher upward displacements.

FIG. 3 depicts a plan view of a portion of a prior art waterslide 300 in which a first straight flume segment 310 is linked to the second straight flume segment 320 of the same cross-section, by a turn 330. The turn 330 may be defined by a separate flume segment, or instead, it maybe formed as a portion of either one of the straight flume segments. The approximate ride path and direction of movement of the rider is shown as arrow 360. As the rider moves into turn 330, a continuation of the rider's original path directs the rider up the interior wall of turn 330. As the rider is now up a slope on the turn 330, the rider is urged by gravity in a downward direction pointing into the center of the turn. As the rider travels downhill toward the center of the flume segment 320, the rider also continues to traverse the ride path and turns the corner.

Thus, the turn 330 and the flume segments 310 and 320, in addition to defining a generally curved path of travel, also define a downward path component due to the concave or tubular wall shape of the flume segments. This downward path component is transverse to the curved slide path, so when the rider has completed the turn, and has returned to straight flume 320, the rider continues to travel in a side-to-side manner. The side-to-side component of velocity remains as an overshoot, creating an oscillating ride path 360. Thus, as the rider travels around turn 330 centrifugal forces move the rider across flume 320, creating an oscillation which is sustained in the ride path 360 for some distance after turn 330.

In order to create sufficient linear speed prior to the turn to create this side-to-side oscillation, a rider must have accelerated sufficiently, for example, by moving downhill from a certain height, thus creating a need for tall waterslide structures. In many waterslides the rider does not move side-to-side very much in the first few turning flume sections. Often, a straight section prior to a turn features an increase in grade and subsequent decrease in grade, creating a dropping section, to increase speed, thereby shortening the required straight.

SUMMARY

The present disclosure provides a waterslide comprising an upstream flume segment having a first cross-section, the upstream flume segment defining a first slide path, and a downstream flume segment having a second cross-section different than the first cross-section, the downstream flume segment defining a second slide path. The waterslide further comprises an angled transition linking the upstream flume segment to the downstream flume segment, wherein the angled transition defines a discontinuity between the upstream and downstream flume segments, thereby defining an inflection between the first and second slide paths.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

The present disclosure relates to an angled waterslide transition which connects two flume segments of different cross-sectional dimensions (shape and/or size). However, rather than having a continuous, smooth slide path of cross-section normals associated with cross-sections of the transition as it is traversed from upstream to downstream, there is a discontinuity creating an inflection. Also, the ride path, as it crosses the boundary between the transition and the downstream flume segment, is not perpendicular to the cross-section of the downstream flume segment. Therefore, the angled waterslide transition, as will be described below, creates a slide path which is continuous, but not smooth, thereby creating an oscillating, side-to-side ride path in the flume segment that is downhill of the angled transition.

As used herein, the term "slide path" refers to the path formed by linking the outward normals of the flume segment cross-sections. The term "ride path" refers to the approximate path a rider would take when sliding down the waterslide or flume. In preferred embodiments, the term "flume segment" refers to a portion of the waterslide course that has a substantially constant cross-section along its length (unless otherwise noted).

Figure 1:
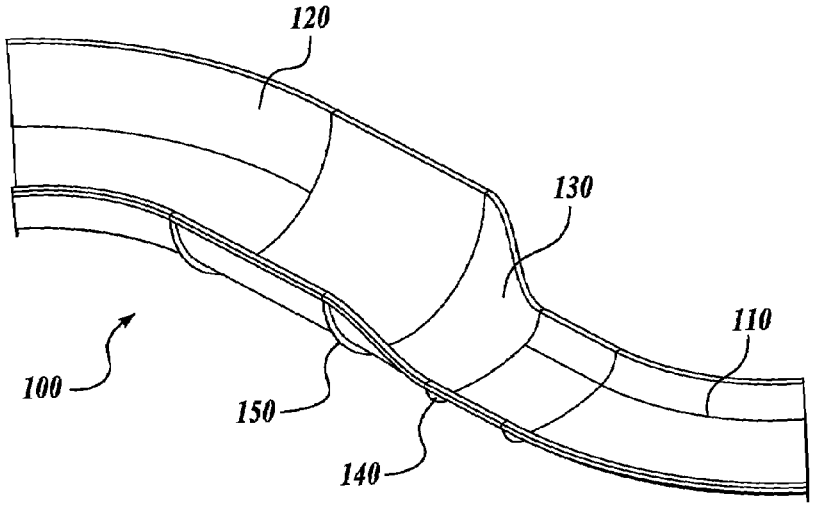
Fig.1. (PRIOR ART)
FIG. 1 is an isometric view of a portion of a prior art waterslide having a conventional waterslide transition linking an upstream flume segment to a downstream flume segment having a larger cross-section.
Figure 2:
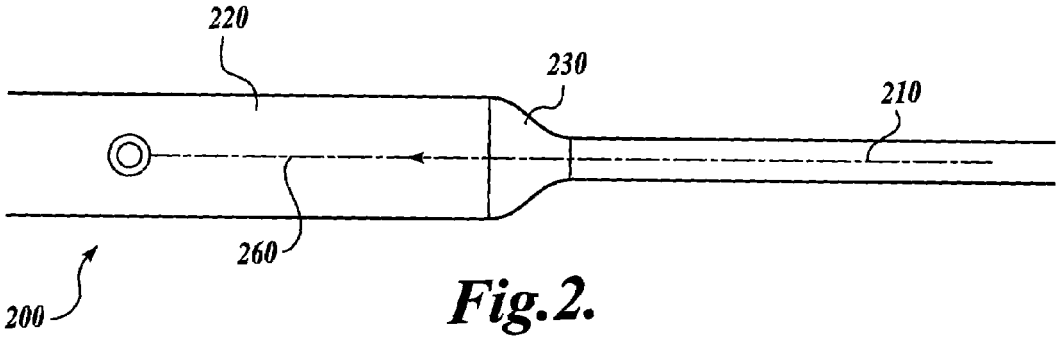
Fig.2. (PRIOR ART)
FIG. 2 is a plan view of a portion of a prior art waterslide having a conventional waterslide transition linking an upstream straight flume segment to a wider downstream straight flume segment.
Figure 3:
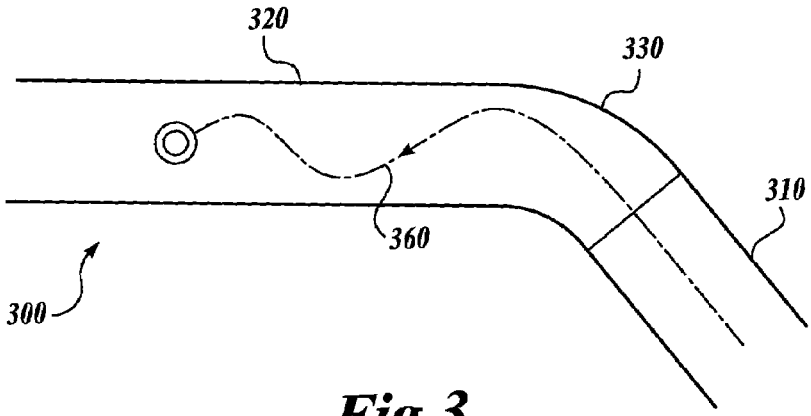
Fig.3. (PRIOR ART)
FIG. 3 is a plan view of a portion of a prior art waterslide having a conventional waterslide turn or curve linking two straight flume segments of the same cross-section, and creating an oscillating, side-to-side ride path in the downstream flume segment.
Figure 4A:
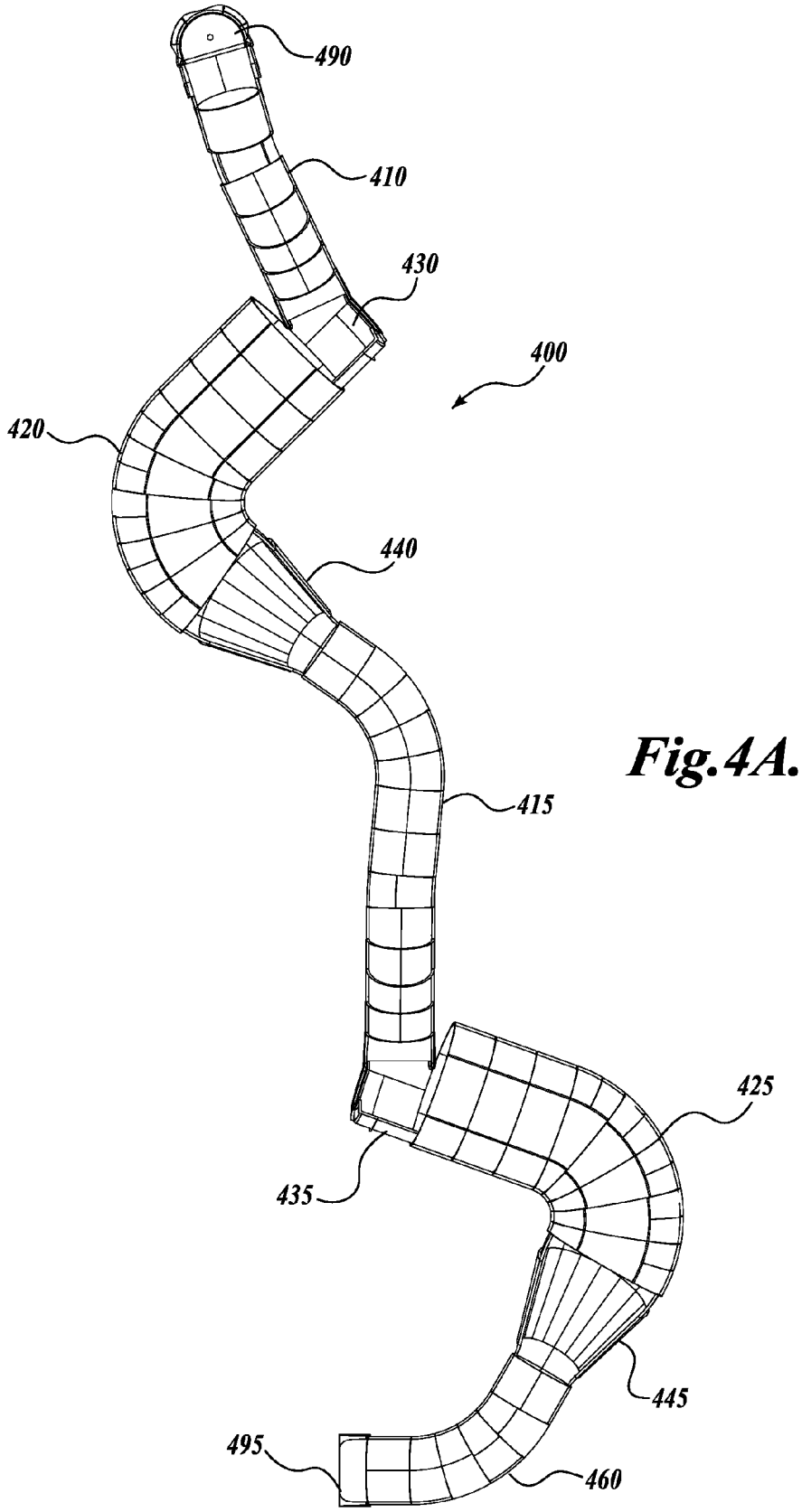
FIG. 4A is a top view of an exemplary embodiment of a waterslide incorporating first and second angled transitions formed in accordance with an embodiment of the present disclosure.
Figure 4B:
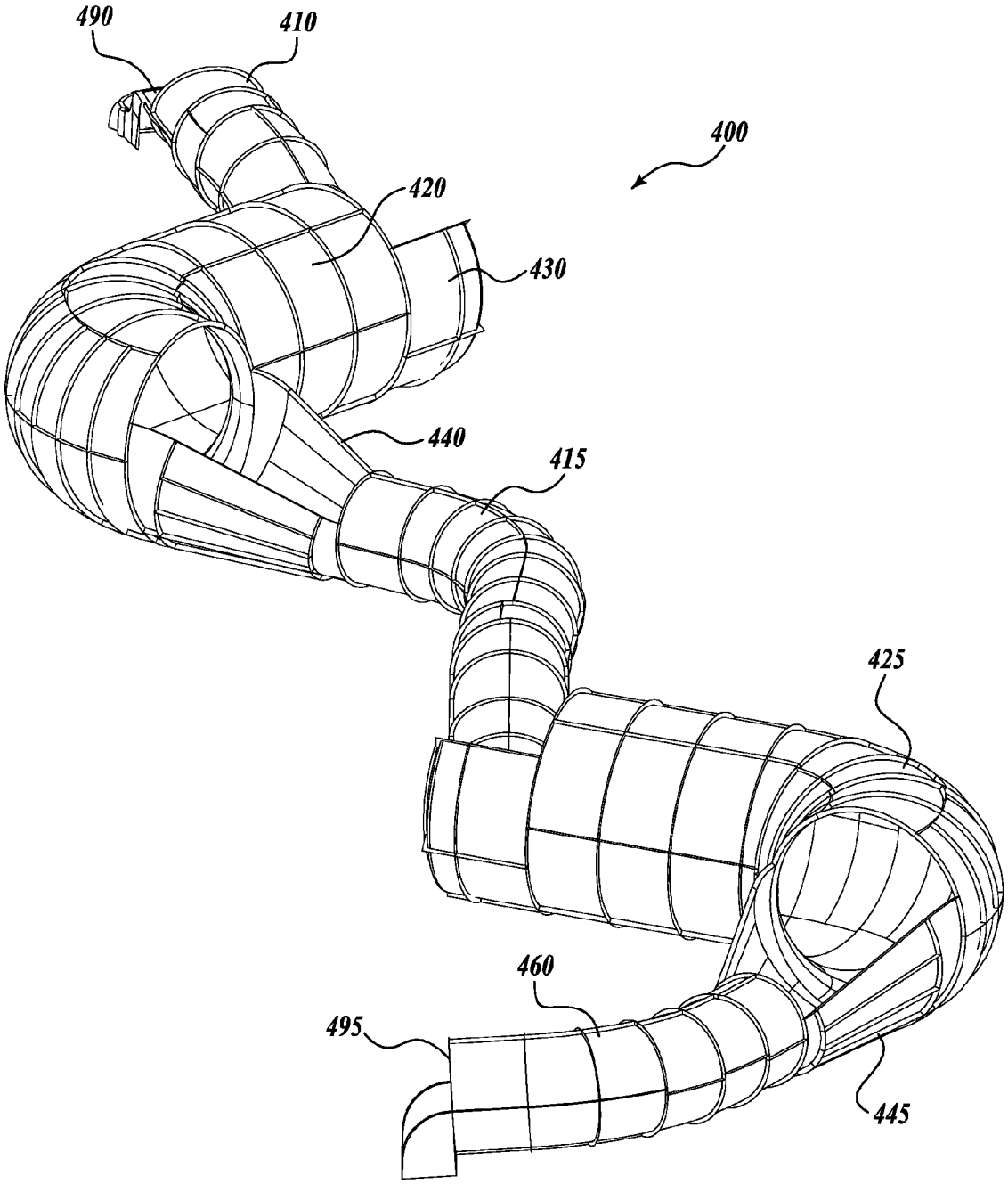
FIG. 4B is a first isometric view of the waterslide of FIG. 4A.
Figure 4C:
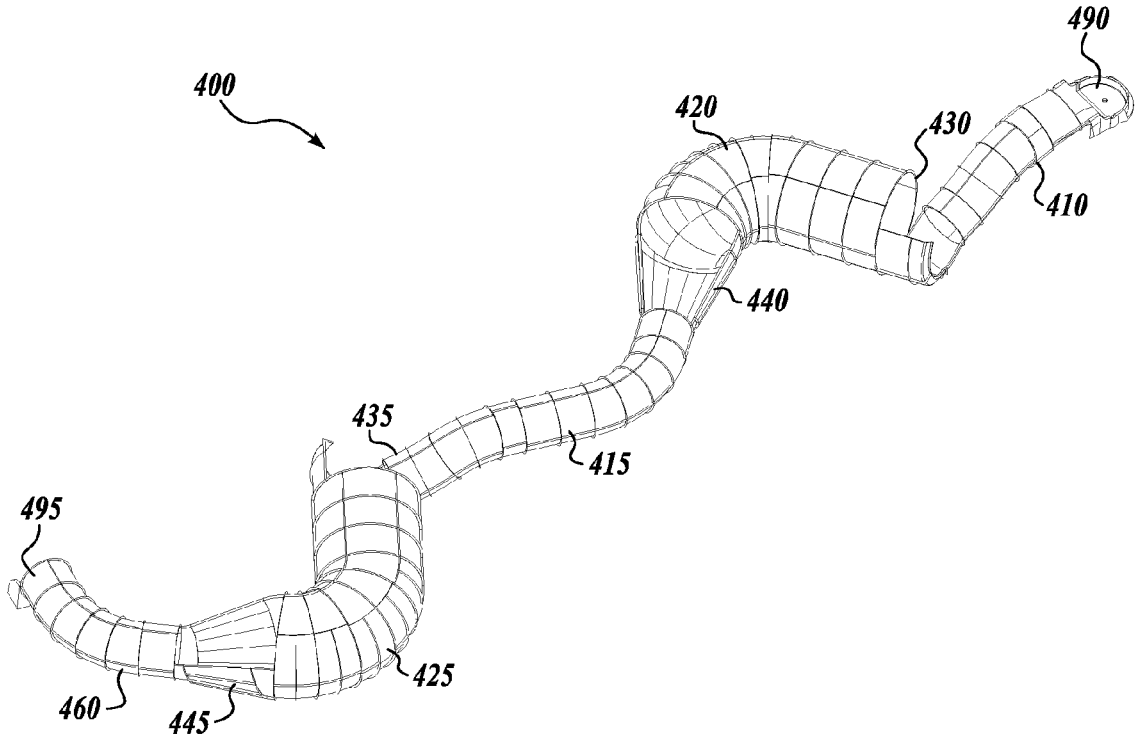
FIG. 4C is a second isometric view of the waterslide of FIG. 4A.

Referring to FIGS. 4A-4C, an exemplary embodiment of a waterslide 400 having angled transitions 430 and 435 formed in accordance with an embodiment of the present disclosure is depicted. Although the waterslide 400 may include any suitable arrangement and combination of flume segments, the waterslide 400 includes an entry 490 at the top, uphill portion of the waterslide 400. The rider enters the waterslide 400 at the entry 490, slides through curved narrow tube flume segment 410 and enters a substantially larger diameter curved tube flume segment 420 via the angled transition 430. As the rider moves through large diameter flume segment 420 the ride path oscillates from side-to-side up and down the interior walls of flume segment 420. The rider exits flume segment 420 via a conventional transition 440, slides through another narrow curved tube flume segment 415, and enters another large diameter curved tube flume segment 425 via another angled transition 435. Again as the rider moves through flume segment 425, the ride path oscillates from side-to-side up and down the interior walls of flume segment 425. The rider exits flume segment 425 via another conventional transition 445, slides through another narrow tube flume segment 460 to the waterslide exit 495.

Figure 5:
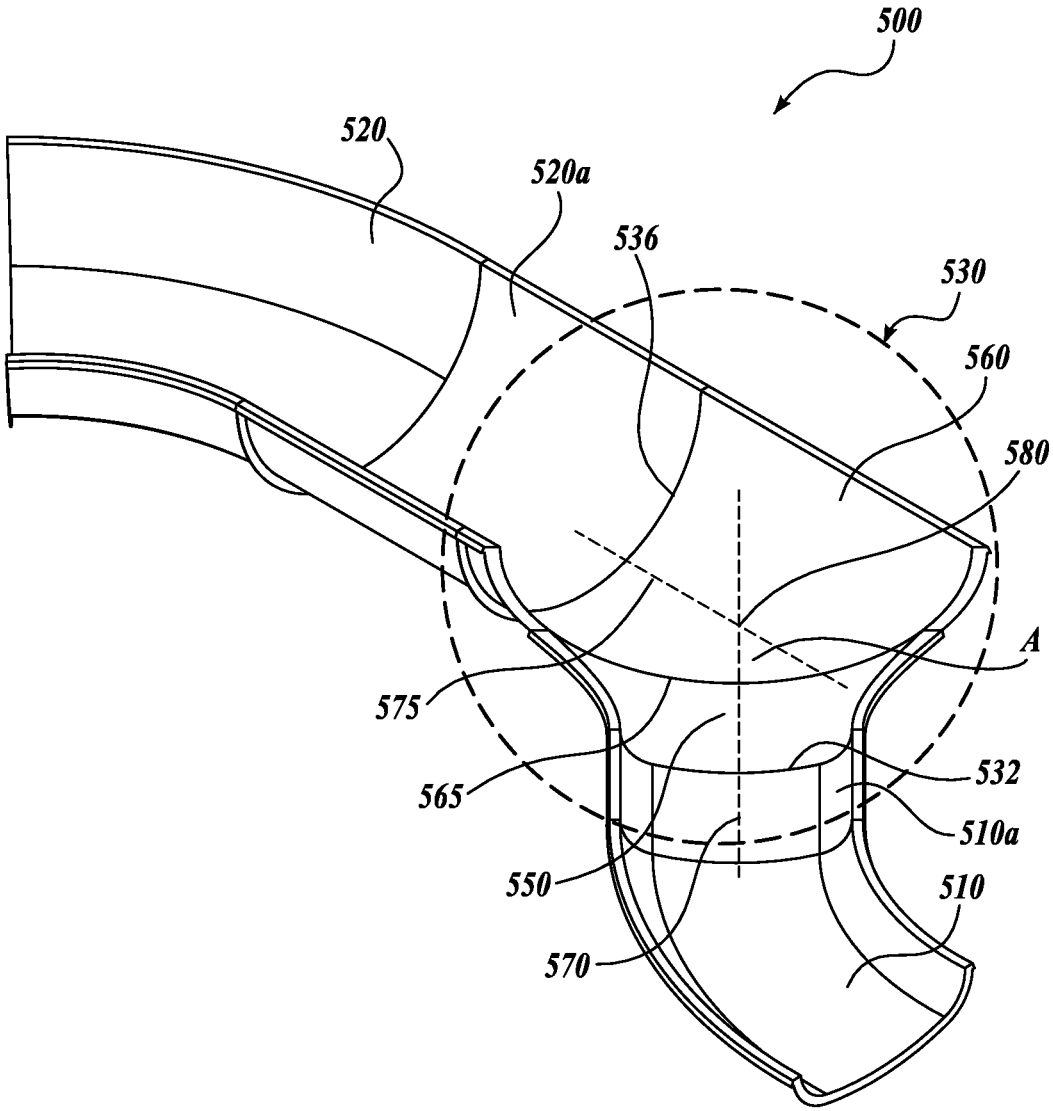
FIG. 5 is an isometric view of an exemplary waterslide portion having an angled transition formed in accordance with an embodiment of the present disclosure.

Referring to FIG. 5, a portion of a waterslide 500 comprising an exemplary embodiment of an angled waterslide transition 530 formed in accordance with an embodiment of the present disclosure is depicted. Such an angled transition 530 can be used with the waterslide 400 described above or with any other suitable waterslide structure. The waterslide 500 comprises an upstream curved flume segment 510 and a downstream curved flume segment 520 having a larger and differently shaped cross-section. Flume segments 510 and 520 each comprise a short straight segment 510*a* and 520*a*, respectively which are linked by angled transition 530.

The angled transition 530 may be comprised of one or more transition segments. In the illustrated embodiment, the angled transition 530 includes a contoured segment 550 that increases in cross-sectional size as it extends from the smaller, upstream flume segment 510*a* towards the larger, downstream flume segment 520*a*, and an angled segment 560 that joins the downstream flume segment 520*a* with the contoured segment 550. At upstream edge 532, the angled transition 530 typically has a flange matching the shape of a corresponding flange on the upstream flume segment 510*a*, and at downstream edge 536 the angled transition 530 typically has a flange matching the shape of a corresponding flange the downstream flume segment 520*a*. Similarly, typically flanges are used to join the other segments that make up the waterslide portion 500.

Although curved flume segments 510 and 520 straighten as they meet transition 530, with the inclusion of straight segments 510*a* and 520*a*, when viewed in plan, upstream flume segment 510 is sharply angled with respect to downstream flume segment 520, and angled transition 530 is shaped and contoured to join the flume segments with a smooth ride surface. The approximate direction of the slide path at the entrance 532 to angled transition 530 is indicated with dashed line 570. The approximate direction of the slide path at the exit 536 from angled transition 530 is indicated with dashed line 575. Rather than having a continuous, smooth slide path of cross-section normals associated with cross-sections of angled transition 530 between its upstream and downstream ends (located at edge or flange 532 and edge or flange 536 respectively), there is a discontinuity creating an inflection shown at 580.

The effect of this discontinuity is to introduce a rider, traveling generally in the direction defined by the slide path 570 of the upstream (smaller) flume segment 510 into the downstream (larger) flume segment 520, at a substantial angle to the slide path 575 of the downstream flume segment 520, causing the rider to have a substantial transverse velocity as they enter downstream flume segment 520. This angle is defined between the slide paths 570 and 575 at the inflection point 580, and is shown as angle "A" in FIG. 4. Preferably the angle A between slide paths 570 and 575 is at least 30°. In preferred embodiments it is substantially larger and can approach 90°. In some waterslide designs it could even exceed 90°.

Introducing a discontinuity of the type described above within an angled transition is accomplished in certain embodiments, including the embodiment illustrated in FIG. 5, by sweeping the cross-section of the downstream flume segment upstream and sectioning it at some angle to define an angled segment. For instance, the downstream flume segment 520 is swept upstream towards the upstream flume segment 510 and sectioned at an upstream edge 565 to define the angled segment 560 which forms part of the angled transition 530. The angled segment 560 meets the contoured segment 550 at upstream edge 565 and meets the straight portion 520*a* of the downstream flume segment 520 at the downstream edge 536. The downstream edge 536 is generally perpendicular to the slide path 575 of the downstream flume segment 520*a* to provide a substantially straight, smooth transition between the angled segment 560 and the remainder of the downstream flume segment 520.

The upstream edge 565 of angled segment 560 is generally perpendicular to the slide path 570 of the upstream flume segment 510. In other words, the section plane introduced by the upstream edge 565 defines an angle between the downstream flume slide path 575 and the section plane at their point of intersection. As such, the angled segment 560 provides a continuation of the slide path 570 defined by the upstream flume segments 510 and 510*a*. Provided that the cross-section of the downstream flume segment 520 being cut by the section plane at edge 565 is bilaterally symmetrical, so too will be the edge 565 of resulting angled section 560 exposed by the section plane as well as the upstream cross-section of the angled transition 530.

Although the angled transition 530 is described above as comprising a contoured segment 550 that increases in cross-sectional size, and an angled segment 560 that joins the contoured segment 550 with the downstream flume segment 520*a*, it should be appreciated that the angled transition 530 may instead be formed by any other suitable combination of pieces or segments. Moreover, it should be appreciated that the angled transition 530 may instead be formed as a single unitary piece or segment. In addition, the size, cross-sectional shape, and angle between the upstream flume segment 510 and the downstream flume segment 520 is for illustration purposes only. Thus, it should be appreciated that the angled transition 530 described above as well as the other angled transition embodiments described throughout the present disclosure may be adapted for use with various flume segments and waterslide assemblies.

Figure 6:
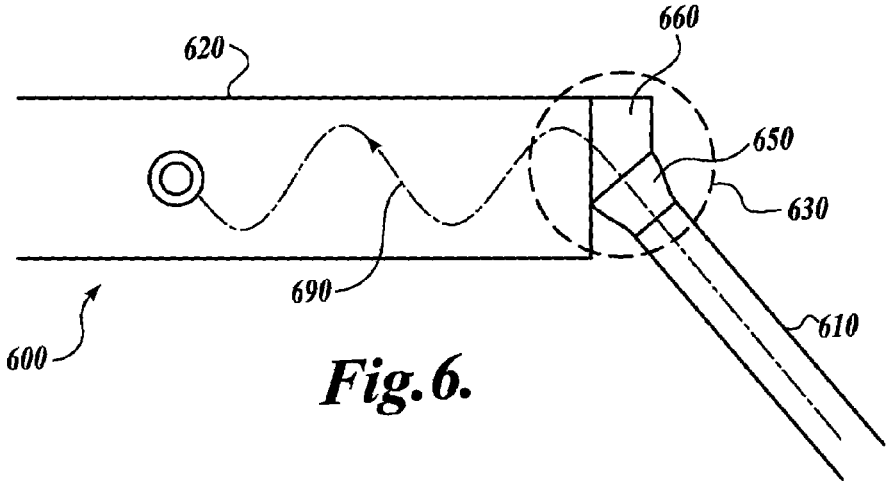
FIG. 6 is a plan view of an exemplary waterslide portion having an angled transition substantially similar to the angled transition of FIG. 5.

FIG. 6 depicts a plan view of a portion of a waterslide 600 similar to that illustrated and described with reference to FIG. 5. Waterslide portion 600 comprises an angled transition 630 linking two flume segments 610 and 620, the upstream flume segment 610 having a smaller cross-section than downstream flume segment 620. Angled transition 630 comprises a contoured segment 650 extending from the upstream flume segment 610, and an angled segment 660 joining the contoured segment 650 and the downstream flume segment 620. The approximate ride path and direction of movement of the rider is shown as arrow 690. As the rider exits transition 630 and enters flume 620, a continuation of the rider's original path directs the rider up the wall of flume 620 and creates an oscillating ride path 690 which is sustained for some distance after transition 630.

Figure 7:
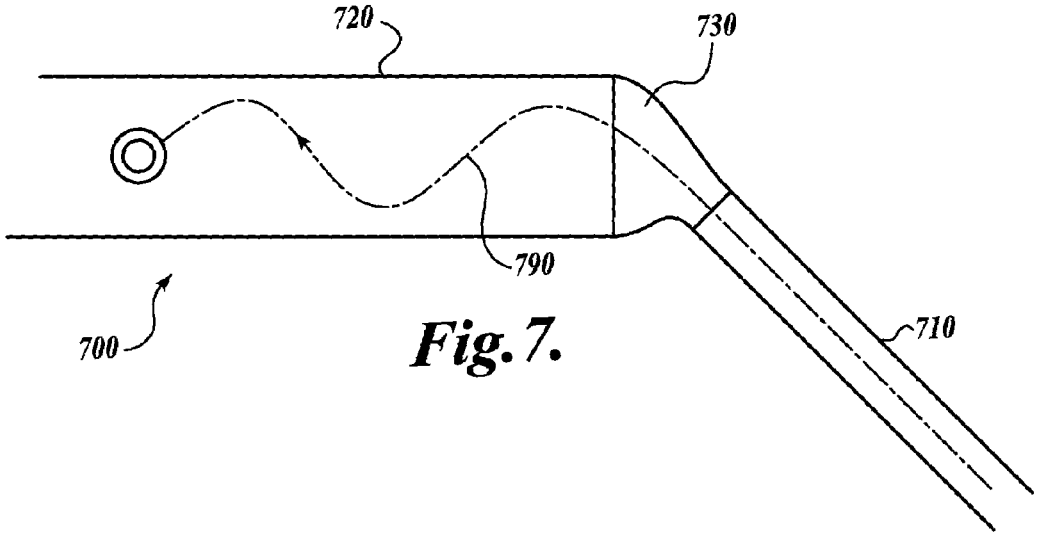
FIG. 7 is a plan view of an exemplary waterslide portion having an angled transition formed in accordance with an embodiment of the present disclosure.

FIG. 7 illustrates a plan view of another embodiment of a portion of a waterslide 700 comprising an angled transition 730 linking two flume segments 710 and 720, the upstream flume segment 710 having a smaller cross-section than downstream flume segment 720. The angled transition 730 is shown as a contoured, unitary segment that connects the upstream flume segment 710 with the downstream flume segment 720, similar to the angled transitions described above, to create the discontinuity between the flume segments 710 and 720. In the illustrated embodiment, the angled transition 730 is formed as one unitary segment; however, it should be appreciated that the angled transition 730 may instead be formed by combining two or more segments to define the same or a substantially similar discontinuity between the flume segments 710 and 720. In any event, the approximate ride path and direction of movement of the rider, as indicated by arrow 790, shows a similar, oscillating ride path in the downstream flume segment 720 to that shown in FIG. 6 above with respect to angled transition 630.

Figure 8:
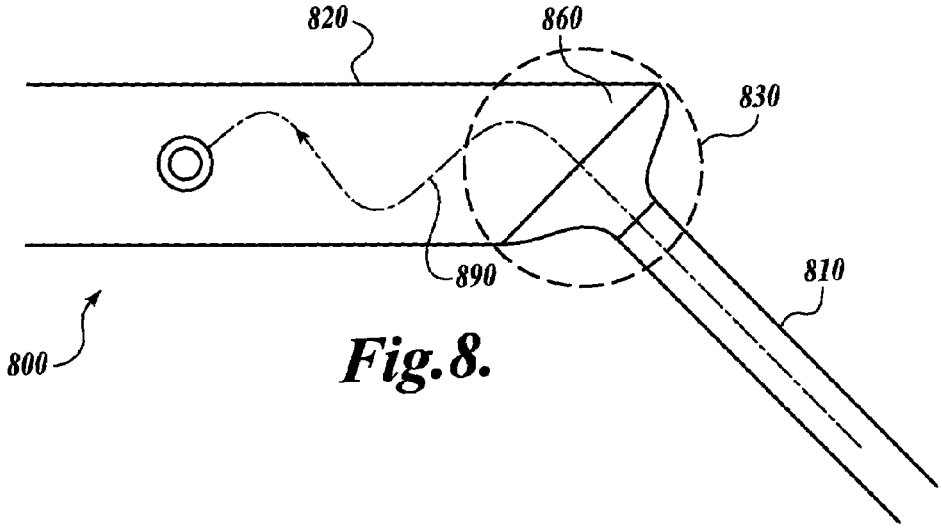
FIG. 8 is a plan view of an exemplary waterslide portion having an angled transition formed in accordance with an embodiment of the present disclosure.

FIG. 8 illustrates a plan view of another embodiment of a portion of a waterslide 800 comprising an angled transition 830 linking two flume segments 810 and 820, the upstream flume segment 810 having a smaller cross-section than downstream flume segment 820. The angled transition 830 is similar to that described above with reference to FIGS. 5 and 6 in that an angled segment 860 is defined at the upstream end of the downstream flume segment 820. However, the angled segment is integrally formed with the downstream flume segment 820. Moreover, only a single contoured segment 850 couples the angled transition segment 860 with the upstream flume segment 810. The approximate ride path and direction of movement of the rider, as indicated by arrow 890, shows a similar, oscillating ride path in the downstream flume segment 820.

As illustrated in FIGS. 6-8, using angled transitions rather than a conventional turn permits the use of an upstream flume segment with a much smaller cross-section while still creating a desirable oscillating ride path. For example, by comparing the ride path 360 shown in the prior art waterslide portion 300 (having a turn 330) to the oscillating ride paths shown in FIGS. 6-8, it can be seen that the angled transition, in addition to coupling flume segments of different cross-sectional sizes, can provide an oscillating ride path without the need for such a steep upstream flume section.

Like flumes, the angled transitions can be formed as one unitary piece or can comprise two or more discrete panels or segments that are fastened together to form the angled transition, as noted above and described with reference to the embodiments of FIGS. 5-8. Moreover, a portion or all of the angled transition can be formed as an integral part of one or both of the two flume segments that it links, such as, for example, the embodiment shown in FIG. 8. Preferably the flume segments and angled transitions are formed from a molded plastic or composite material. Fiberglass resin composites are particularly suitable.

Figure 9A:
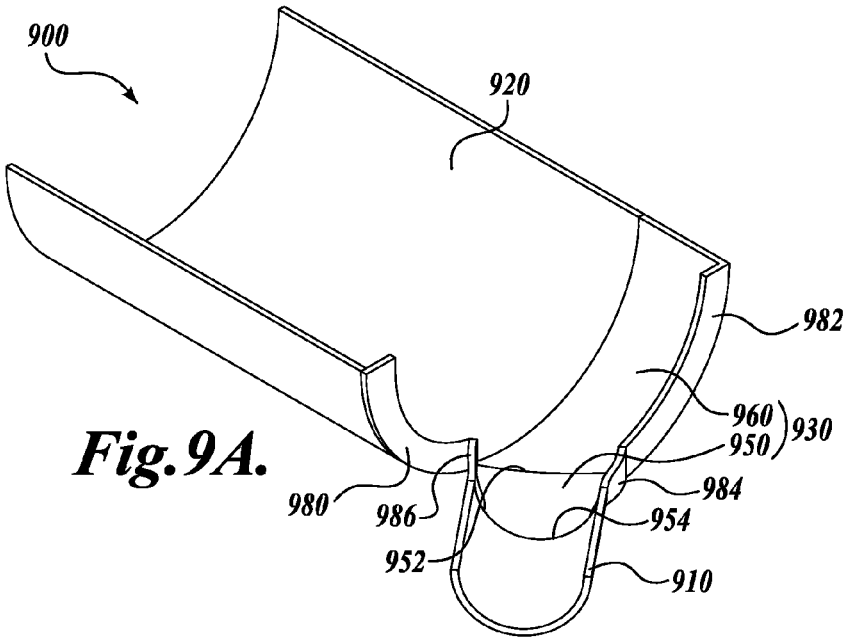
FIG. 9A is an isometric view of an exemplary waterslide portion having an angled transition formed in accordance with an embodiment of the present disclosure.
Figure 9B:
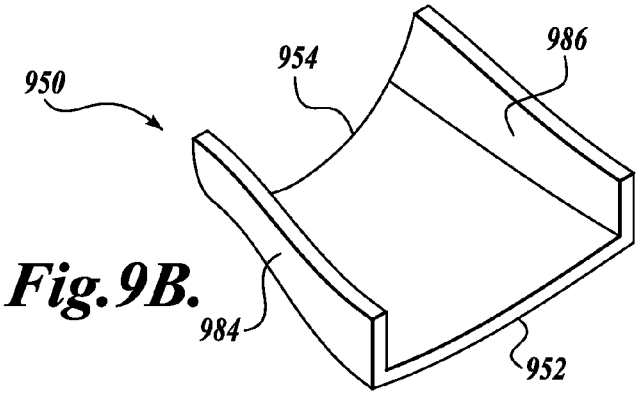
FIG. 9B is an isometric view of a portion of the angled transition of FIG. 9A.
Figure 9C:
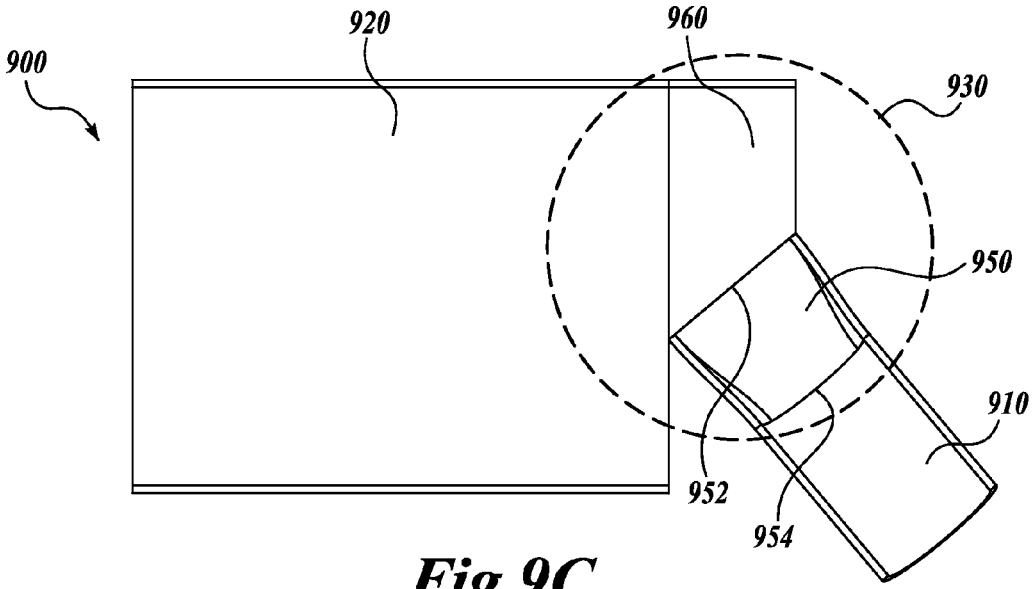
FIG. 9C is a plan view of the waterslide portion and angled transition of FIG. 9A.

FIGS. 9A-9C depict another embodiment of a waterslide portion 900 comprising an angled transition 930 linking two flumes 910 and 920, the upstream flume 910 having a smaller cross-section than downstream flume 920. The waterslide portion 900 and angled transition 930 is substantially similar to the waterslide portions 500 and 600 and angled transitions 530 and 630 described above with respect to FIGS. 5 and 6. More specifically, angled transition 930 comprises an angled segment 960 formed or secured to the upstream end of the downstream flume segment 920. The angled transition 930 further comprises a contoured, substantially straight segment 950 secured to the angled segment 960 at edge 952 and secured to the upstream flume segment 910 at edge 954.

In addition, transverse flanges or rims 980 and 982 are defined at or secured to the upstream end of the downstream flume segment 920 and the upstream end of the angled segment 960, respectively. The flanges or rims 980 and 982 extend from the upper, open end of the downstream flume segment 920/angled segment 960 downwardly toward the contoured segment 950. The flanges or rims 980 and 982 may define a substantial continuation of wall portions 984 and 986 formed along each side of the contoured segment 950. As such, the flanges or rims 980 and 982 help retain water within the waterslide portion 900 in the area of the angled transition 930.

Figure 10:
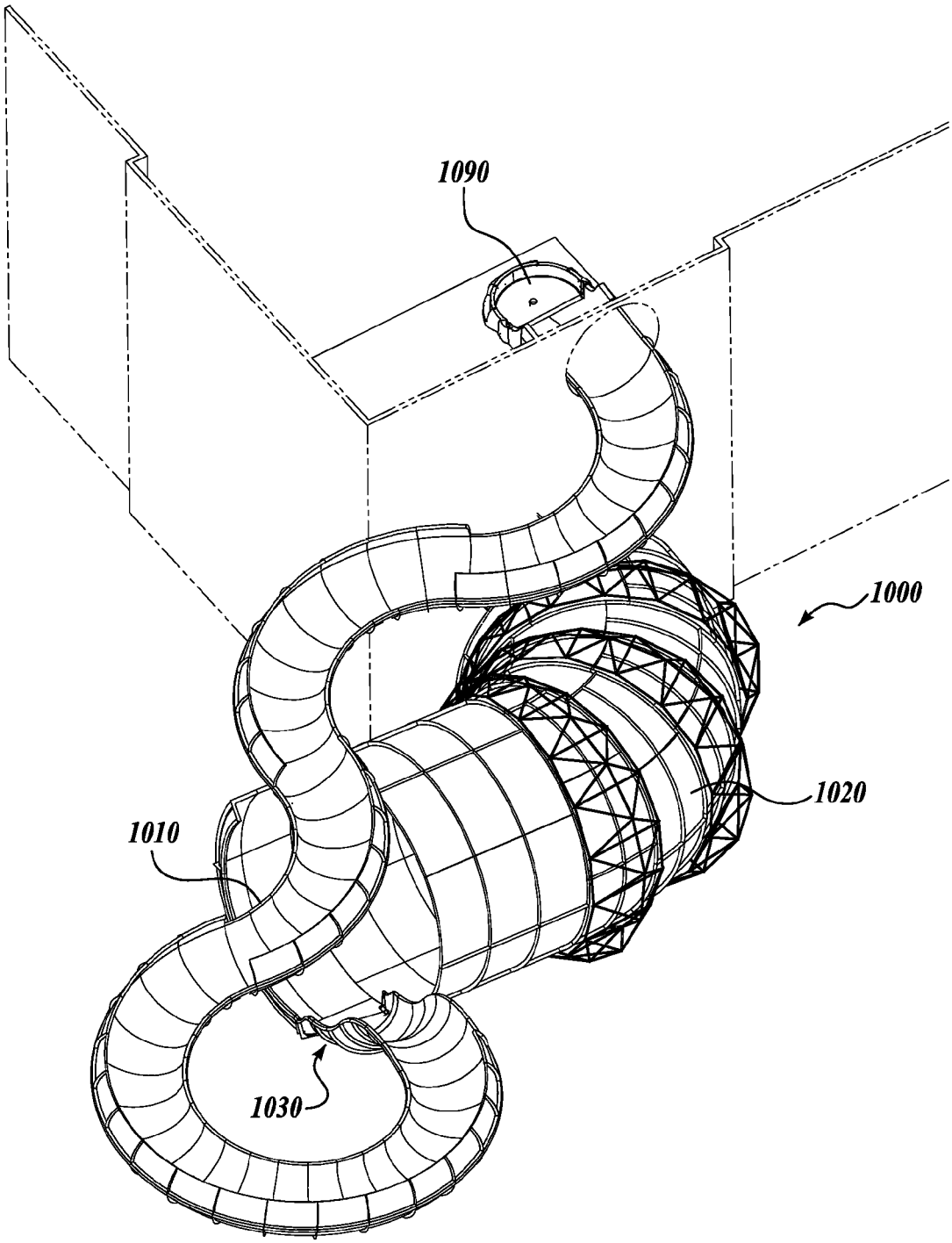
FIG. 10 is an isometric view of an exemplary waterslide incorporating an angled transition formed in accordance with an embodiment of the present disclosure.

FIG. 10 shows another embodiment of a waterslide 1000 incorporating an angled transition 1030 that joins and creates a discontinuity between an open-channel flume segment 1010 and a large, curved closed-tube flume segment 1020. A rider enters waterslide 1000 at the top or entry 1090, slides through series of turns in the open-channel flume segment(s) 1010 and enters the substantially larger diameter curved tube flume segment 1020 via the angled transition 1030. As the rider moves through flume 1020, the ride path oscillates from side-to-side up and down the interior walls of flume 1020. The rider exits flume 1020 via a conventional transition (not shown) and continues to the waterslide exit.

It should be appreciated that one or more angled transitions of the type described herein can be used in a single waterslide to form or provide the entrance to one or more flume segments as part of a waterslide course. Moreover, waterslides comprising flume segments linked by one or more angled transitions of the type described herein can be large enough to accommodate a family raft or other multiple-rider conveyance device or can be sized so that they are suitable for a single rider or user with or without a conveyance device.

Angled transitions of the type described herein can be used to convert forward motion to combined forward and transverse motion to define an oscillating slide path for the rider in a downstream flume segment. This can offer at least some or all of the following advantages:

(i) inducing an exhilarating side-to-side motion in the downstream flume segment;

(ii) increasing the ride time and ride path length, per unit length of flume, thereby decreasing the waterslide length needed for a satisfactory ride experience;

(iii) permitting the use of narrower (less costly) flume segments in portions of the waterslide while still achieving an oscillating side-to-side ride path in other portions;

(iv) decreasing the waterslide height and/or slope required in order to achieve a particular type of ride experience; and (v) allowing the waterslide to occupy less space (for example, a smaller footprint) and require less material (for example, fiberglass panels and support structure) in order to create a given type of ride experience.

While particular elements, embodiments and applications of the present disclosure have been shown and described, it will be understood, that the present disclosure is not limited thereto since modifications can be made by those skilled in the art without departing from the scope of the present disclosure, particularly in light of the foregoing teachings.

The embodiments of the present disclosure in which an exclusive property or privilege is claimed are defined as follows:

1. A waterslide comprising:

(a) an upstream flume segment having a first cross-section, the upstream flume segment defining a first slide path;

(b) a downstream flume segment having a second cross-section that is different than the first cross-section and is substantially constant along the length of the downstream flume segment, the downstream flume segment defining a second slide path, wherein the downstream flume segment is a closed tube flume segment; and (c) an angled transition linking the upstream flume segment to the downstream flume segment, the angled transition defining a discontinuity between the upstream and downstream flume segments thereby defining an inflection between the first and second slide paths such that a rider traveling from the upstream flume segment travels up a wall of the downstream flume segment.

2. The waterslide of claim 1, wherein the angled transition comprises at least first and second transition segments secured together.

3. The waterslide of claim 2, wherein the first transition segment is defined by a portion of the downstream flume segment terminated at an upstream edge that is at an angle to the slide path of the downstream flume segment.

4. The waterslide of claim 3, wherein the upstream edge of the first transition segment is substantially perpendicular to the slide path of the upstream flume segment.

5. The waterslide of claim 4, wherein the second transition segment extends between the first transition segment and the upstream flume segment, and wherein the second transition segment increases in cross-sectional size as the second transition segment extends between the upstream flume segment and the first transition segment.

6. The waterslide of claim 1, wherein the angled transition defines an oscillating side-to-side ride path in the downstream flume segment.

7. The waterslide of claim 1, wherein the cross-section of the downstream flume segment is substantially larger than the cross-section of the upstream flume segment.

8. The waterslide of claim 1, wherein the cross-sectional radius of the downstream flume segment is at least about four times greater than the maximum cross-sectional radius of the upstream flume segment.

9. The waterslide of claim 1, wherein the downstream flume segment is curved.

10. The waterslide of claim 1, wherein the upstream flume segment is an open-channel flume segment.

11. The waterslide of claim 1, wherein the upstream flume segment is a tubular flume segment.

12. The waterslide of claim 1, wherein the angled transition is an open-channel.

13. In a waterslide having an upstream flume segment having a first cross-section defining a first slide path and a downstream flume segment being a closed tube flume segment having a second cross-section, different than the first cross section, defining a second slide path and being substantially constant along the length of the downstream flume segment, an angled transition for linking the upstream flume segment to the downstream flume segment to define an oscillating side-to-side ride path in the downstream flume segment, the angled transition comprising: (a) a first transition segment defined by a portion of the downstream flume segment terminated at an upstream edge that is at an angle to the slide path of the downstream flume segment; and (b) a second transition segment extending between the first transition segment and the upstream flume segment.

14. The angled transition of claim 13, wherein the upstream edge of the first transition segment is substantially perpendicular to the slide path of the upstream flume segment.

15. The angled transition of claim 13, wherein the cross-section of the downstream flume segment is larger than the cross-section of the upstream flume segment.

16. The angled transition of claim 15, wherein the second transition segment increases in cross-sectional size as the second transition segment extends between the upstream flume segment and the first transition segment.

17. The angled transition of claim 13, further comprising a first rim extending along at least a portion of a substantially transverse upstream edge of the downstream flume segment.

18. The angled transition of claim 17, further comprising a second rim extending along at least a portion of a substantially transverse upstream edge of the first transition segment.

19. A waterslide portion comprising:

(a) an upstream flume segment having a first cross-section, the upstream flume segment defining a first slide path;

(b) a downstream flume segment having a second cross-section that is different than the first cross-section and is substantially constant along the length of the downstream flume segment, the downstream flume segment defining a second slide path, wherein the downstream flume segment is a closed tube flume segment; and (c) an angled transition linking the upstream flume segment to the downstream flume segment such that a rider traveling from the upstream flume segment travels up a wall of the downstream flume segment, the angled transition comprising:

(i) a first transition segment defined by a portion of the downstream flume segment terminated at an upstream edge that is at an angle to the slide path of the downstream flume segment; and (ii) a second transition segment extending between the first transition segment and the upstream flume segment.

20. The waterslide portion of claim 19, wherein the upstream edge of the first transition segment is substantially perpendicular to the slide path of the upstream flume segment.

21. The waterslide portion of claim 19, wherein the cross-section of the downstream flume segment is larger than the cross-section of the upstream flume segment.

22. The waterslide portion of claim 19, wherein the second transition segment increases in cross-sectional size as the second transition segment extends between the upstream flume segment and the first transition segment.

23. The waterslide portion of claim 19, further comprising a first rim extending along at least a portion of a substantially transverse upstream edge of the downstream flume segment.

* * * * *